US008695123B2

(12) United States Patent
Lanza

(10) Patent No.: US 8,695,123 B2
(45) Date of Patent: Apr. 15, 2014

(54) VENTILATED TOILET

(76) Inventor: Franklin Lanza, Kirtland Hills, OH (US)

( * ) Notice: Subject to any disclaimer, the term of this patent is extended or adjusted under 35 U.S.C. 154(b) by 0 days.

(21) Appl. No.: 13/532,471

(22) Filed: Jun. 25, 2012

(65) Prior Publication Data

US 2013/0247290 A1 Sep. 26, 2013

Related U.S. Application Data

(60) Provisional application No. 61/500,200, filed on Jun. 23, 2011.

(51) Int. Cl.
*E03D 9/04* (2006.01)

(52) U.S. Cl.
USPC ..... 4/213; 4/216; 4/219

(58) Field of Classification Search
USPC ..... 4/213, 216, 219
See application file for complete search history.

(56) References Cited

U.S. PATENT DOCUMENTS

| | | | |
|---|---|---|---|
| 2,297,035 | A | 9/1942 | Svec |
| 3,192,539 | A | 7/1965 | Martz |
| 3,896,509 | A | 7/1975 | Stipp |
| 4,103,370 | A | 8/1978 | Arnold |
| 5,054,131 | A | 10/1991 | Sim |
| 5,079,782 | A | 1/1992 | Sim |
| 5,253,371 | A | 10/1993 | Slawinski |
| 5,305,472 | A | 4/1994 | Eger |
| 5,493,737 | A | 2/1996 | Chu |
| 5,715,543 | A | 2/1998 | Sim |
| 6,073,275 | A | 6/2000 | Klopocinski |
| 6,173,453 | B1 | 1/2001 | Sahar |
| 6,499,150 | B1 | 12/2002 | Thompson |
| 6,526,598 | B1 | 3/2003 | Black |
| 6,928,666 | B1 | 8/2005 | Schaffer |
| 2003/0229937 | A1 | 12/2003 | Curtis |
| 2005/0273917 | A1 * | 12/2005 | Lapossy ..... 4/213 |

FOREIGN PATENT DOCUMENTS

| | | |
|---|---|---|
| DE | 2818496 | 11/1979 |
| GB | 2181168 | 4/1987 |
| JP | 0105836 | 8/1979 |
| JP | 0120432 | 5/1990 |

* cited by examiner

*Primary Examiner* — Tuan N Nguyen
(74) *Attorney, Agent, or Firm* — Fay Sharpe LLP

(57) ABSTRACT

The present disclosure further provides a toilet for exhausting odorous air therefrom, comprising a bowl, a trap, a housing, a self-contained ventilation system, a water tank, and a water supply line. The bowl has a rim therearound wherein the bowl communicates with the rim. The main trap is contained in the bowl wherein the trap is for communicating the contents in the bowl with a drain conduit so as to provide a passageway from the bowl to a drain stack. The ventilation system includes an exhaust blower having a blower inlet and a blower outlet. The blower inlet is in communication with air space between the contents in the bowl and the rim. The blower outlet is in communication with the drain conduit downstream from the trap. The exhaust blower including a cut-off switch for deactivating the exhaust blower during a flush.

14 Claims, 6 Drawing Sheets

VENTILATED TOILET

The present application claims the priority benefit of U.S. provisional patent application Ser. No. 61/500,200 filed Jun. 23, 2011, the disclosure of which is incorporated herein by reference.

BACKGROUND

The present disclosure relates to a toilet. More particularly, the present disclosure relates to a toilet including a ventilation system for exhausting odorous air therefrom.

It is apparent that numerous innovations for toilets have been provided in the prior art that are adapted to be used. Furthermore, even though these innovations may be suitable for the specific individual purposes to which they address, however, they would not be suitable for the purposes of the present disclosure as heretofore described.

BRIEF SUMMARY

The present disclosure provides a method for exhausting odorous air from a toilet that avoids the disadvantages of the prior art and is simple to use.

The present disclosure provides a toilet for exhausting odorous air therefrom, comprising a bowl, a trap, a self-contained ventilation system, a water tank, and a water supply line. The bowl has a rim therearound wherein the bowl communicates with the rim. The bowl is for receiving human waste that produces the odorous air. The main trap is contained in the bowl, wherein the trap is for communicating the contents in the bowl with a drain conduit so as to provide a passageway from the bowl to a drain stack. The ventilation system includes an exhaust blower having a blower inlet and a blower outlet. The blower inlet is in communication with air space between the contents in the bowl and the rim. The blower outlet is in communication with the drain conduit downstream from the trap. The exhaust blower further including a check valve between the blower outlet and the drain conduit for preventing the odorous air from flowing upstream from the drain stack into the blower outlet. The check valve is spring biased to a closed position and when closed blocks the odorous air from the drain conduit to the blower outlet. The check valve is selectively biased to an open position when the exhaust blower is activated at a pressure at the blower outlet thereby opening the check valve to allow odorous air to flow from the blower outlet to the drain conduit; and, wherein the exhaust blower includes a cutoff switch for deactivating the exhaust blower during a flush of the toilet The present disclosure further provides a toilet for exhausting odorous air therefrom, comprising a bowl, a trap, a self-contained ventilation system, a water tank, and a water supply line. The bowl has a rim therearound wherein the bowl communicates with the rim. The bowl is for receiving human waste that produces the odorous air. The main trap is contained in the bowl wherein the trap is for communicating the contents in the bowl with a drain conduit so as to provide a passageway from the bowl to a drain stack. The ventilation system includes an exhaust blower having a blower inlet and a blower outlet. The blower inlet is in communication with air space between the contents in the bowl and the rim. The blower outlet is in communication with the drain conduit downstream from the trap. The exhaust blower including a cut-off switch for deactivating the exhaust blower during a flush. The shut-off switch comprising a float switch operably deactivated when a float drops during a flush and operably activates when the float rises when a level of the water in the tank moves down and up, respectively. The cut-off switch interrupts power temporarily to the exhaust blower during a flush while the float drops and rises, and resumes power to the exhaust blower when the float reaches a select water level in the tank.

The novel features which are considered characteristic of the present disclosure are set forth in the appended claims. The disclosure itself, however, both as to its construction and its method of operation, together with additional objects and advantages thereof, will be best understood from the following description of the specific embodiments when read and understood in connection with the accompanying drawing.

BRIEF DESCRIPTION OF THE DRAWINGS

The figures of the drawing are briefly described as follows.

DETAILED DESCRIPTION

Figure 1:
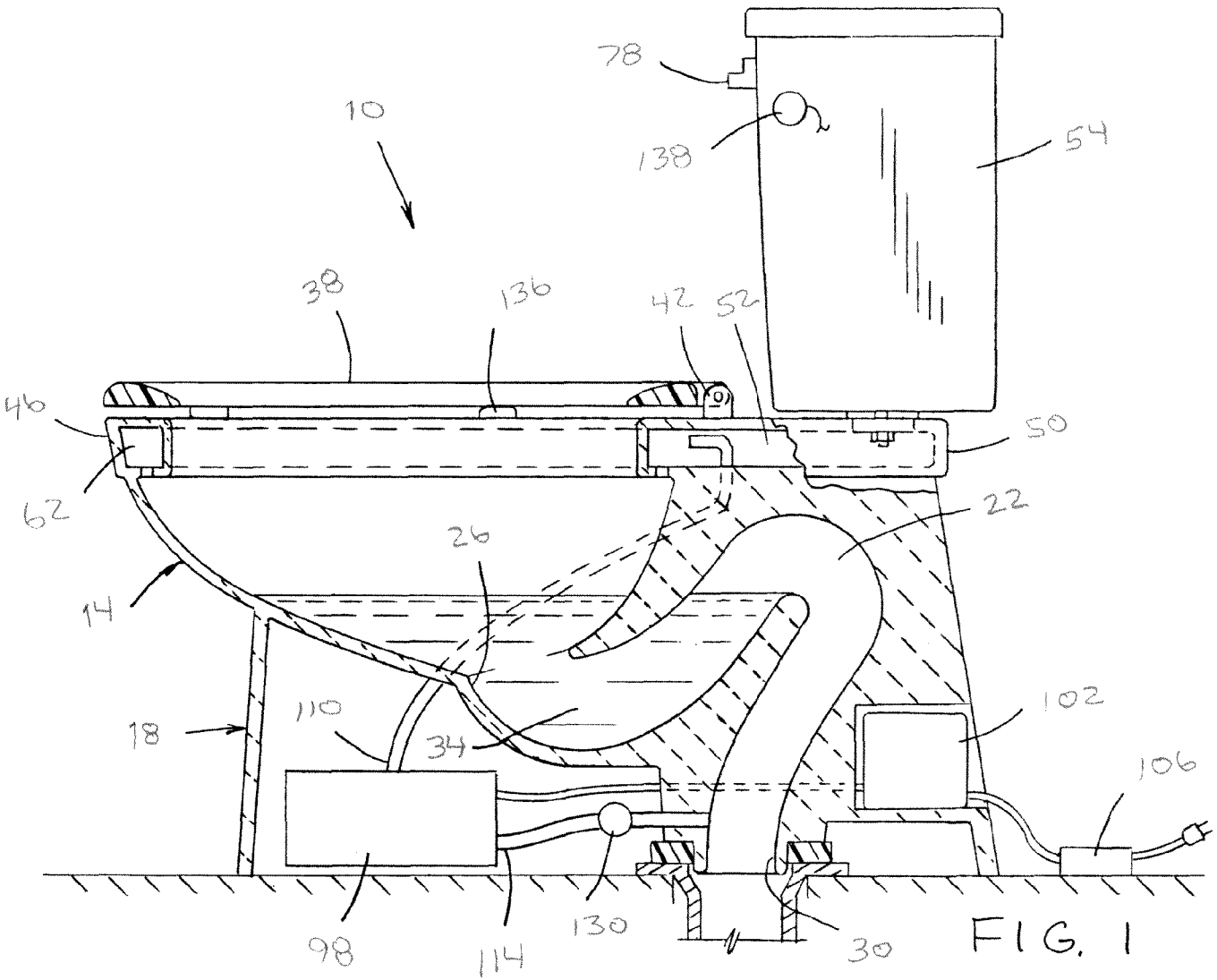
FIG. 1 is an enlarged diagrammatic cross sectional view of a toilet assembly.

Referring now to the figures, in which like numerals indicate like parts, and particularly to FIG. 1, which is a diagrammatic cross sectional view of the present disclosure, the toilet assembly of the present disclosure is shown generally at 10 for exhausting odorous air (not shown) therefrom.

The configuration of the toilet assembly 10 can best be seen in FIG. 1, which is a diagrammatic cross sectional view of the toilet 10, and as such, will be discussed with reference thereto.

It will be understood that each of the elements described above, or two or more together, may also find a useful application in other types of constructions differing from the types described above.

While the disclosure has been illustrated and described as embodied in a toilet for exhausting odorous air therefrom, however, it is not limited to the details shown, since it will be understood that various omissions, modifications, substitutions and changes in the forms and details of the device illustrated and its operation can be made by those skilled in the art without departing in any way from the spirit of the present disclosure.

Without further analysis, the foregoing will so fully reveal the gist of the present disclosure that others can, by applying current knowledge, readily adapt it for various applications without omitting features that, from the standpoint of prior art, fairly constitute characteristics of the generic or specific aspects of this disclosure.

The present development relates to a self-contained ventilated toilet assembly 10 as illustrated in FIGS. 1, 2, 2A, and 3-5. The toilet 10 includes a bowl 14 defined as part of a pedestal base 18. The pedestal base 18 defines a drain conduit 22. The drain conduit 22 begins at a waste outlet 26 that communicates with the bowl 14 and extends to a stack outlet 30 that is adapted to communicate with a conventional drain stack of a house or other structure (not shown) in which the toilet is installed. The drain conduit 22 comprises a trap 34 that collects a volume of water to block flow of sewage gases from the drain stack into the bowl 14 by way of the drain conduit 22. A ring or U-shaped toilet seat 38 is pivotally connected to the pedestal base 18 by a hinge 42 and generally conforms to the dimensions of a rim 46 of the bowl so as to provide a seating location for a user of the toilet 10.

Figure 2:
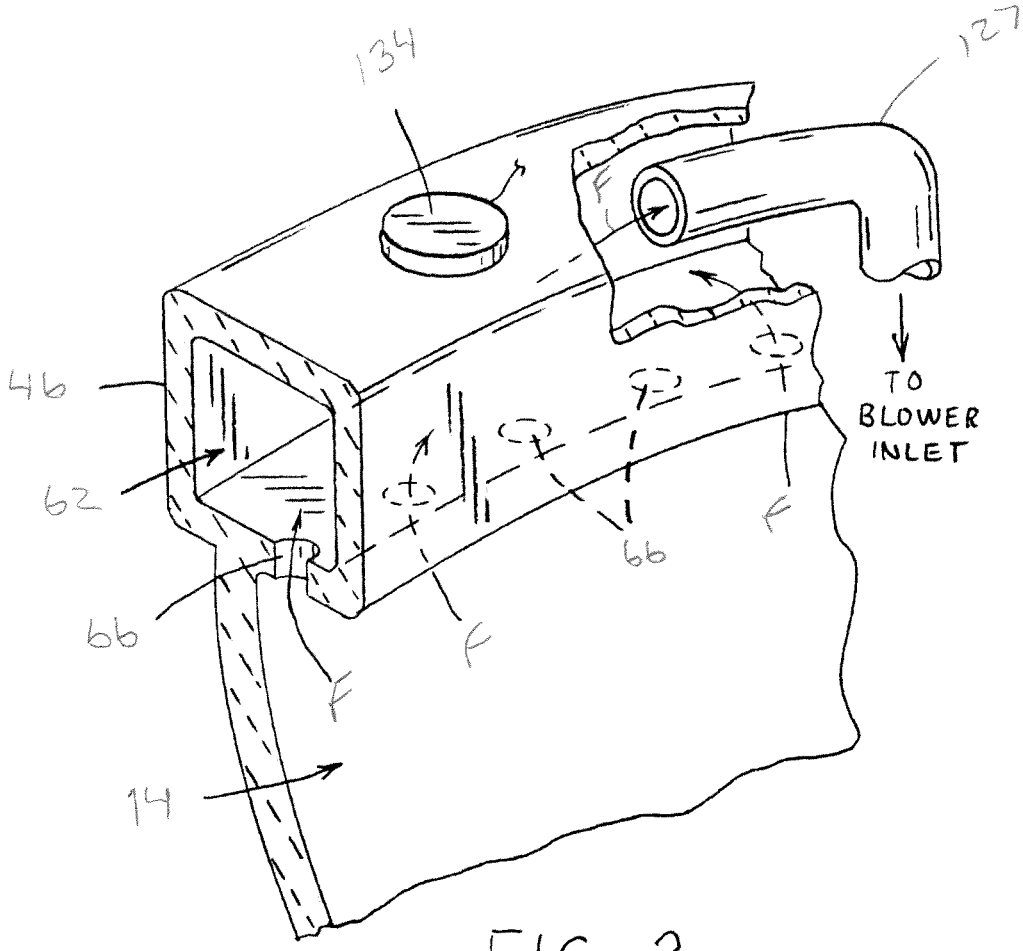
FIG. 2 is an enlarged cross sectional view of a portion of a toilet bowl and rim.

The pedestal base 18 defines a neck 50 that extends horizontally outward from the rim 46 of the bowl 14 at the rear of the rim/bowl. A tank 54 is supported on/above the neck 50 and is adapted to contain a volume of water 58 that is selectively communicated to the bowl 14 for supplying water and flushing waste from the bowl through waste outlet 26, into the drain conduit 22, and out of the drain conduit 22 via stack outlet 30 into the drain stack. More particularly, the rim 46 of the bowl defines an internal rim conduit 62 as shown in FIGS. 1 and 2. A lower region of the rim conduit 62 includes a plurality of apertures 66 that communicate with the bowl. During a flush of the toilet 10, water 58 from the tank 54 flows into a neck conduit 52 of the neck 50 which communicates with the rim conduit 62 such that the water 58 flows from the neck conduit 52 into the rim conduit 62. Water flowing in the rim conduit 62 flows out of the apertures 66 into the bowl 14 such that the contents of the bowl 14 are flushed into the drain conduit 22 via waste outlet 26.

Figure 3:
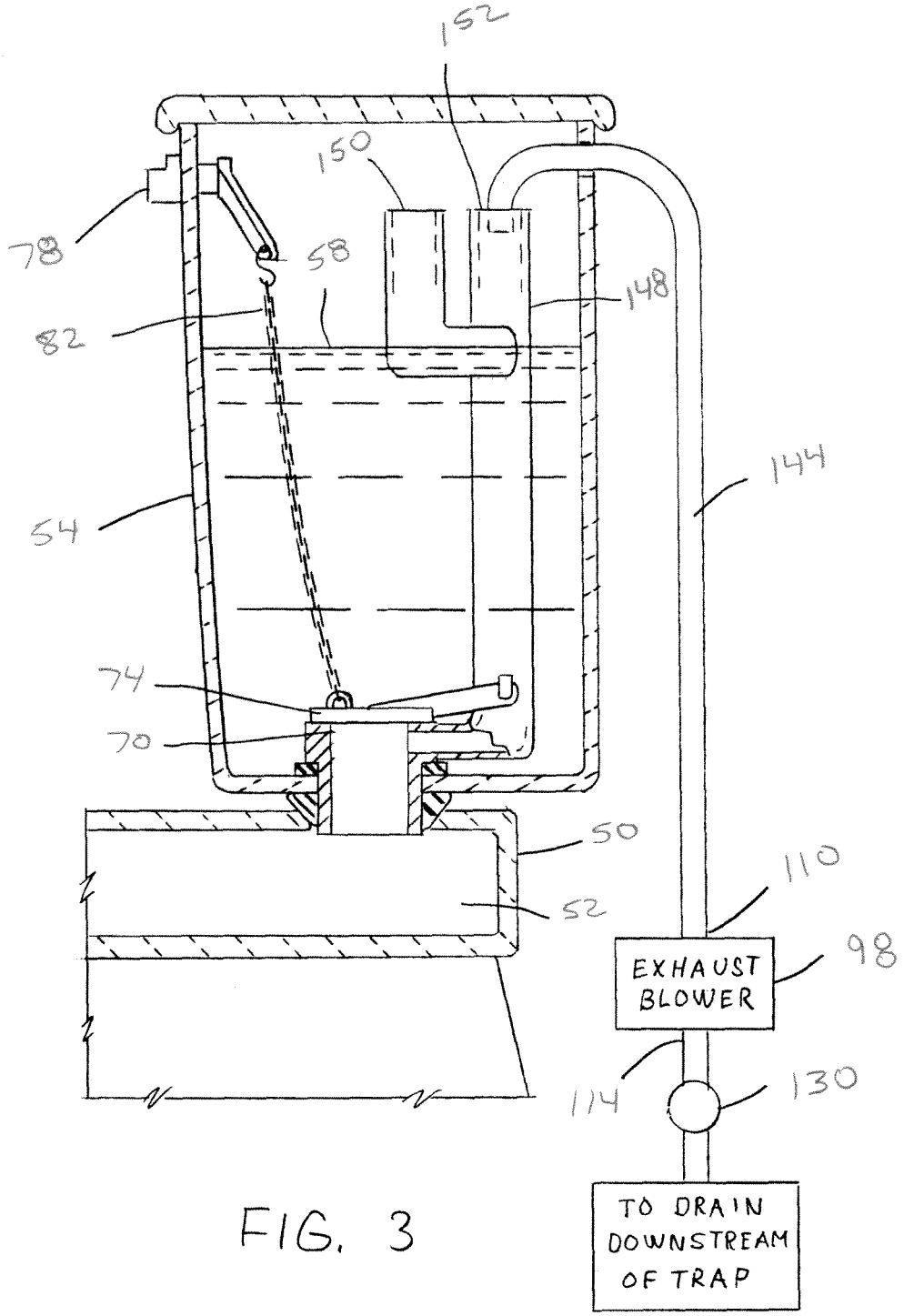
FIG. 3 is a cross sectional side view of a toilet tank.
Figure 4:
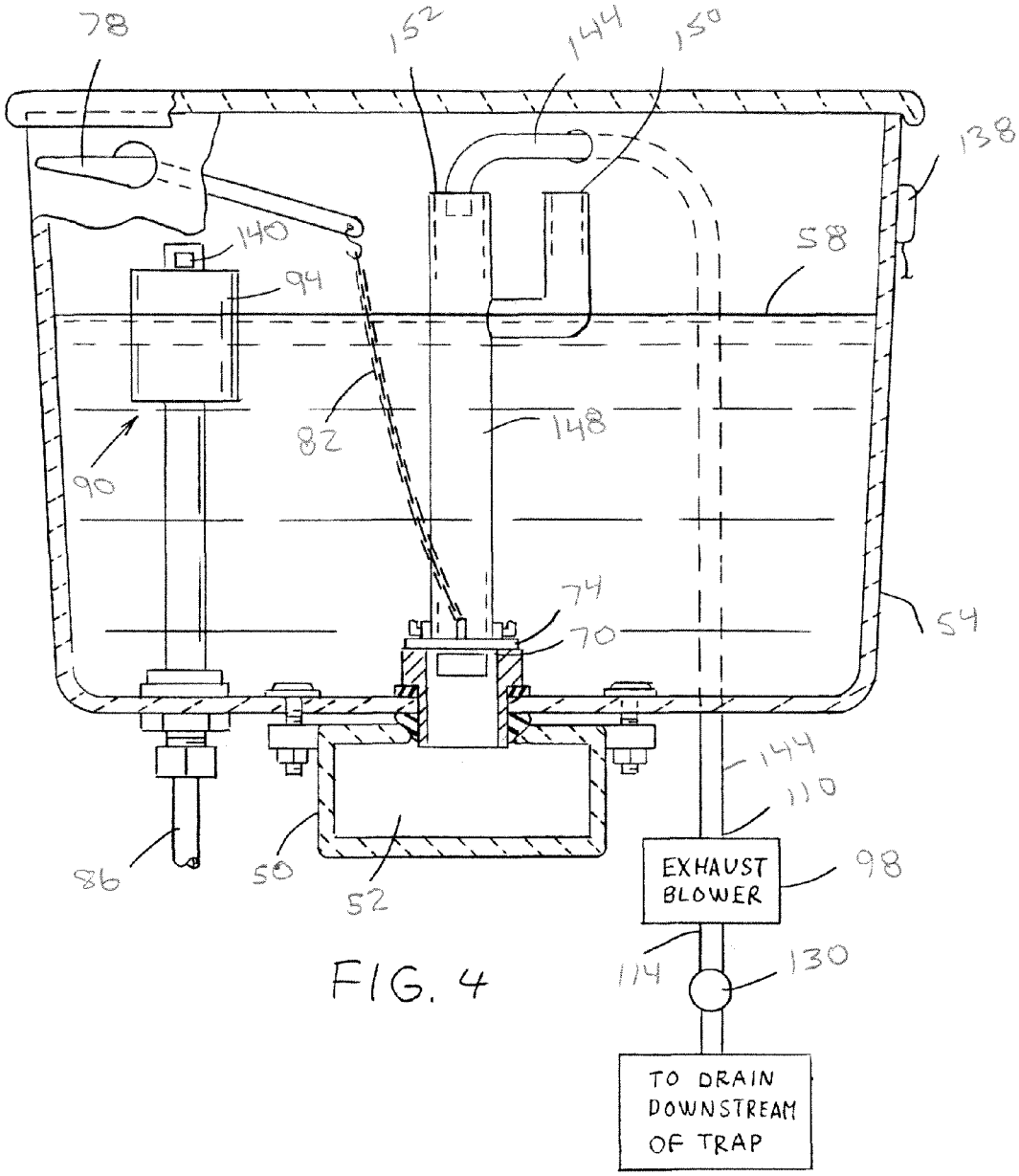
FIG. 4 is a cross sectional front view of the toilet tank.

As shown in FIGS. 3 and 4, the tank 54 comprises a flush opening 70 that is in fluid communication with the neck conduit 52 (which is in fluid communication with the rim conduit 62). A flush valve 74 is located in the tank and normally seats over the flush opening 70 to block same. The flush valve 74 (e.g., a flapper or other type of valve) is selectively unseated by user manipulation of a flush handle 70, which is connected to the flush valve 74 by a linkage such as a chain 82 or other member(s). When the flush valve 74 is unseated, water 58 in the tank 54 flows by gravity into the flush opening 70, neck conduit 52, rim conduit 62 and rim apertures 66 for flushing the bowl 14 as described above. When the user releases the handle 78, the flapper or other flush valve 74 is normally re-seated over the flush opening 70 to block same.

As shown in FIG. 4, the tank 54 is connected to a water supply line 86, and a float valve 90 is located in the tank 54 and controls the flow of water 58 into the tank 54 to refill same after a flush. In particular, the float valve 90 comprises a float 94 that moves up and down with the level of water 58 in the tank 54. When the level of water 58 in the tank drops during a flush, the float 94 drops and opens the float valve 90 to allow flow of water into the tank 54 from the supply line 86. When the flush valve 74 closes and the level of the water 58 in the tank 54 rises to a select level, the float 94 is elevated sufficiently to close the float valve 90 to stop the flow of water into the tank via supply line 86.

Unlike a conventional toilet, the toilet 10 comprises a self-contained ventilation system to evacuate noxious gases from the bowl 14. In the illustrated embodiment, the self-contained ventilation system can be automatically activated when a user of the toilet 10 is seated on the toilet seat 38, but alternative activation systems are contemplated, such as a manual on/off switch connected to the toilet 10. The toilet 10 comprises an exhaust blower 98 housed in the pedestal base 18 (or alternatively mounted outside the pedestal base). The exhaust blower 98 is electrically connected to a low-voltage source of electrical power. In one example, the low-voltage source of electrical power comprises a rechargeable battery 102 (e.g., 12 volts) that can be also housed in the pedestal base 18. The battery 102 can be removable for recharging and/or can be adapted to be recharged by selectively connecting the pedestal base 18 to a source of electrical power. In another example, the toilet 10 comprises a DC power supply 106 (alone or in combination with the battery) that is connected to a conventional wall outlet for input of AC electrical power and output of DC electrical power, e.g., 9 to 12 volts DC to the exhaust blower 98. In either case, when the exhaust blower 98 is activated, it draws air and other gases into its blower inlet 110 and exhausts same through its blower outlet 114.

Figure 2A:
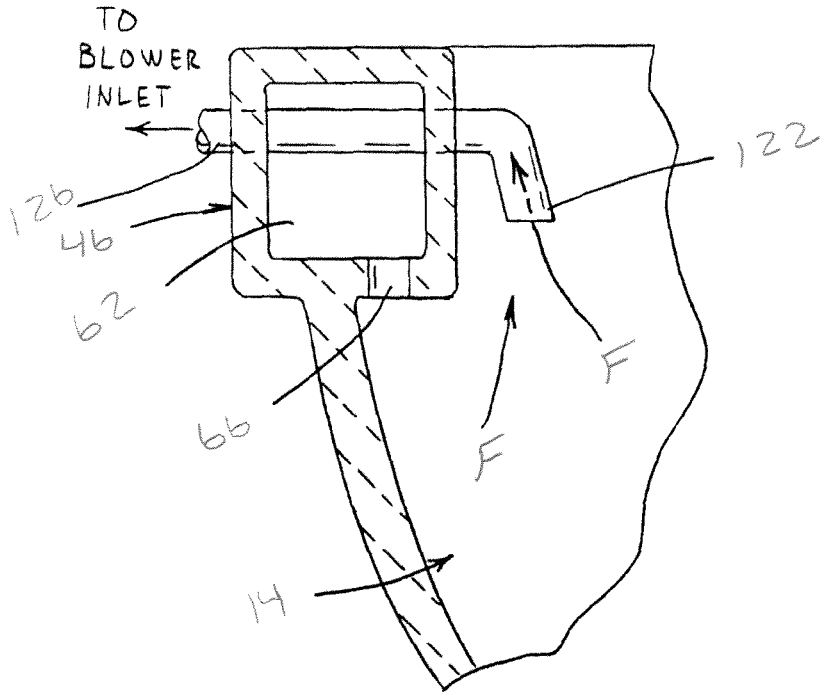
FIG. 2A is an enlarged cross sectional view of a portion of the toilet bowl and rim.

According to the present development, the blower inlet 110 is in communication with the interior of the bowl 14 (i.e., generally the space in the bowl 14 between the top of the rim 46 (above) and any water or other contents of the bowl (below), and the blower outlet 114 is in communication with the drain conduit 22 downstream from the trap 34 (i.e., at a location in the drain conduit 22 preferably between the trap 34 and stack outlet 30 where gases flowing into the drain conduit 22 from the blower outlet 114 will not be able to flow back to the bowl 14 via the drain conduit 22). In one embodiment as shown in FIG. 2A, a nozzle 122 is connected to the rim 46 and is located in the bowl 14 between the top of the rim 46 and the contents of the bowl 14. The nozzle 122 is in communication with the blower inlet 110 through a hose or other conduit/path 126 such that noxious fumes and odors F are drawn from the bowl 14 into the nozzle 122 and flow to the blower inlet 110 and then to the blower outlet 114 when the exhaust blower 98 is active. In another embodiment as shown in FIG. 2, the blower inlet 110 is in communication with the rim conduit 62 (directly or via the neck conduit 52). In such case, the blower inlet 110 is in communication with the interior of the bowl 14 through a rim conduit hose 127 and the rim conduit apertures 66 such that noxious fumes and odors F are drawn from the bowl 14 into the apertures 66 and rim conduit 62 (and optionally also the neck conduit 52 depending upon the location where the blower inlet 110 is connected to the rim conduit 62 and/or neck conduit 52) and flow to the blower inlet 110 and then to the blower outlet 114 when the exhaust blower 98 is active.

During periods when the exhaust blower 98 is inactive, to prevent noxious sewer gases from flowing upstream from the drain stack and drain conduit 22 into the blower outlet 114, through the exhaust blower 98 and into the bowl 14 by way of the blower inlet 110, the toilet 10 further comprises a check valve 130 located between the blower outlet 114 and the drain conduit 22. The check valve 130 is spring biased to its closed position and, when closed, blocks flow of sewer gases from the drain conduit 22 to the blower outlet 114. When the exhaust blower 98 is activated, pressure at the blower outlet 114 opens the check valve 130 such that air and odors can flow from the blower outlet 114 into the drain conduit 22. In one example, the check valve 130 opens in response to a predeterminable pounds per square inch (PSI) of air pressure. When the blower 98 is deactivated, the check valve 130 automatically returns to its normally closed condition.

The exhaust blower 98 can be connected to a toggle switch or other manually activated switch 138 located on the toilet or elsewhere. It is preferred, however, that the exhaust blower 98 be automatically activated when a user is seated on the toilet seat 38. As such, the toilet comprises at least one and preferably first and second seat switches 134, 136 (see also FIG. 5) that are connected to the rim 46 and that are located between the rim 46 and toilet seat 38. If multiple switches are used, they are preferably located on opposite lateral sides of the bowl 14 or are otherwise distributed about the rim 46. The switches 134, 136 are adapted to be activated (closed) by pressure upon a user being seated on the toilet seat 38. The seat switches 134, 136 are preferably spring-loaded and are deactivated (opened) when the user is unseated from the toilet seat 38. The exhaust blower 98 is activated when at least one of the seat switches 134, 136 is closed, and is deactivated when both seat switches 134, 136 are opened. Alternatively, the toilet 10 can comprise one or more contact or non-contact sensors that are activated by the presence of a user near the toilet and/or seated on the toilet seat 38, such that the exhaust blower 98 is activated only when the sensors are activated.

The exhaust blower 98 is preferably water-compatible and/or submersible such that it is capable of drawing water into the blower inlet 110 and exhausting same via blower outlet 114. Nonetheless, for the embodiment of FIG. 2 (where the blower inlet 110 is in communication with the neck conduit 52 and rim conduit 62), it has been deemed desirable to deactivate the exhaust blower 98 during a flush of the toilet 10, to minimize noise and the possibility of drawing water from the rim conduit 62 into the blower inlet 110. In such embodiment, the toilet 10 comprises a cut-off switch for deactivating the exhaust blower 98 during a flush. For example, as shown, the toilet 10 comprises a float switch 140 (FIGS. 4 and 5) that is deactivated (opened) when the float 94 drops during a flush and that is activated (closed) when the float 94 is elevated when the level of water 58 in the tank 54 rises (which indicates that the flush valve 74 is closed and the flush has ended). When the float switch 140 is opened during a flush, electrical power to the exhaust blower 98 is interrupted and the exhaust blower 98 is temporarily deactivated, until the float switch 140 closes when the tank 54 is sufficiently re-filled.

Figure 5:
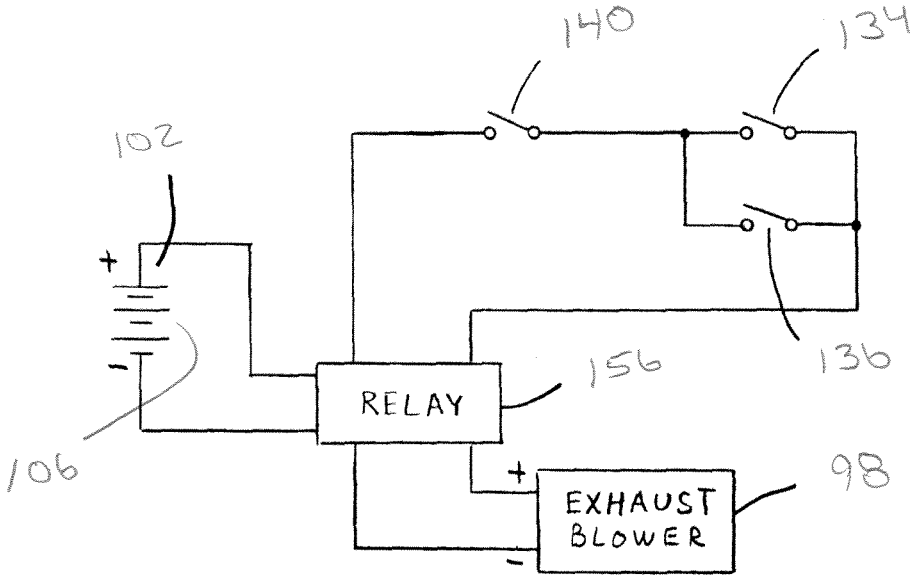
FIG. 5 is an electrical circuit schematic according to the present disclosure.

As shown in FIG. 1, the blower inlet 110 can be directly connected to the rim conduit and/or neck conduit 52 through a hose or other path, e.g., through a conduit defined in the porcelain or other material from which the pedestal 18 and/or bowl 14 are defined/fabricated. Alternatively, as shown in FIGS. 4 and 5, the blower inlet 110 is connected through a hose or other conduit 144 to an open upper portion of an overflow tube 148 that is located in the tank 54. Unlike a conventional overflow tube, the overflow tube 148 includes first and second openings 150, 152, one of which 150 functions as a conventional overflow tube opening (to drain excess water 58 from the tank 54 around the flush valve 74 to the neck conduit 52) and the other of which 152 is connected to the blower inlet 110 through the hose or other conduit 144 (shown in broken lines). Because the overflow tube 148 is in communication with the neck conduit 52, the blower inlet 110 will also be in communication with the neck conduit 52 and rim conduit 62 and rim conduit apertures 66.

As noted above, any hose or other conduit or path or part thereof referred to herein can be defined as an integral and/or one-piece construction with the bowl 14 and/or pedestal 18 and/or tank 54 of the toilet, i.e., the conduit or path can be defined entirely or partly by an opening defined in the toilet 10, itself, and need not be a separate hose, pipe, etc.

FIG. 5 shows one example of a suitable electrical circuit for the toilet 10. The battery and/or power supply 102, 106 is connected to a relay 156 that is connected to the exhaust blower 98 and that selectively supplies electrical power to the exhaust blower 98. In particular, the relay 156 supplies electrical power to the exhaust blower 98 only when the float switch (if present) is closed and when at least one of the seat switches 134, 136 (or the single seat switch if only one is used) is closed. The switches 134, 136, 138, 140 can be in a low voltage/amperage path (e.g., at or below a predeterminable limit (volts, amps, etc.) to maximize their life and prevent burn-out of same as could would occur without the relay.

The disclosure claimed is:

1. A toilet for exhausting odorous air therefrom, comprising:

a bowl;

a trap;

a self-contained ventilation system;

a water tank;

a water supply line;

said bowl has a rim therearound wherein said bowl communicates with said rim;

said bowl is for receiving human waste that produces the odorous air;

said trap is contained in said bowl;

wherein said trap is for communicating the contents in said bowl with a drain conduit so as to provide a passageway from said bowl to a drain stack;

said ventilation system includes an exhaust blower having a blower inlet and a blower outlet;

said blower inlet in communication with air space between the contents in said bowl and said rim;

said blower outlet in communication with said drain conduit downstream from said trap;

said exhaust blower further including a check valve between said blower outlet and said drain conduit for preventing the odorous air from flowing upstream from said drain stack into said blower outlet;

said check valve is spring biased to a closed position and when closed blocks the odorous air from said drain conduit to said blower outlet;

said check valve is selectively biased to an open position when said exhaust blower is activated at a pressure at said blower outlet thereby opening said check valve to allow odorous air to flow from said blower outlet to said drain conduit; and, wherein said exhaust blower includes a cut-off switch for deactivating said exhaust blower during a flush of said toilet.

2. The toilet as defined in claim 1, wherein said cut-off switch comprises a float switch that is deactivated when a float drops during said flush and is activated when said float is elevated when a level of water in said tank rises and a flush valve is closed.

3. The toilet as defined in claim 1, wherein said pressure includes a predeterminable PSI.

4. The toilet as defined in claim 2, further comprising a pressure sensitive switch; wherein said pressure sensitive switch extends operatively upwardly from said rim of said bowl; and wherein said pressure sensitive switch is activated when the user sits on said bowl, and when activated, causes said exhaust blower to activate.

5. The toilet as defined in claim 2, further comprising a toggle switch; wherein said toggle switch is for being manually activated by the user, and when activated, causes said exhaust blower to activate.

6. A toilet for exhausting odorous air therefrom, comprising:

a bowl;

a trap;

a self-contained ventilation system;

a water tank;

a water supply line;

said bowl has a rim therearound wherein said bowl communicates with said rim;

said bowl is for receiving human waste that produces the odorous air;

said trap is contained in said bowl;

wherein said trap is for communicating the contents in said bowl with a drain conduit so as to provide a passageway from said bowl to a drain stack;

said ventilation system includes an exhaust blower having a blower inlet and a blower outlet;

said blower inlet in communication with air space between the contents in said bowl and said rim;

said blower outlet in communication with said drain conduit downstream from said trap;

said exhaust blower including a cut-off switch for deactivating said exhaust blower during a flush;

said cut-off switch comprising a float switch operably deactivated when a float drops during a flush and operably activated when said float rises when a level of the water in said tank moves down and up, respectively; and, said cut-off switch interrupts power temporarily to said exhaust blower during a flush while said float drops and rises, and resumes power to said exhaust blower after said float rises and reaches to a predeterminable water level in said tank.

7. The toilet as defined in claim 6, further comprising:

said exhaust blower further including a check valve between said blower outlet and said drain conduit for preventing the odorous air from flowing upstream from said drain stack into said blower outlet;

said check valve is spring biased to a closed position and when closed blocks the odorous air from said drain conduit to said blower outlet; and, said check valve is selectively biased to an open position when said exhaust blower is activated at a pressure at said blower outlet thereby opening said check valve to allow odorous air to flow from said blower outlet to said drain conduit.

8. A toilet for exhausting odorous air therefrom, comprising:

a bowl;

a trap;

a self-contained ventilation system;

a water tank;

a water supply line;

said bowl has a rim therearound wherein said bowl communicates with said rim;

said bowl is for receiving human waste that produces the odorous air;

said trap is contained in said bowl;

wherein said trap is for communicating the contents in said bowl with a drain conduit so as to provide a passageway from said bowl to a drain stack;

said ventilation system includes an exhaust blower having a blower inlet and a blower outlet;

said blower inlet in communication with air space above the contents in said bowl;

said blower outlet in communication with said drain conduit downstream from said trap;

said rim including a seat and a pressure sensitive switch thereunder;

said switch for initially activating said blower in response to a user sitting on said seat;

said exhaust blower including a cut-off switch for subsequently temporarily deactivating said exhaust blower during a flush;

said cut-off switch comprising a float switch operably deactivated when a float drops during the flush;

said float switch operably activated when said float begins to rise thereby resuming power to said blower while said tank is supplied with water from said water line; and, said power continues to said blower after said float reaches to a predeterminable water level in said tank and while said user continues sitting on said seat.

9. The toilet as defined in claim 8, wherein said pressure sensitive switch deactivates said blower in response to the user removing pressure from said seat.

10. A method for exhausting odorous air from a toilet, comprising:

selectively operating a self-contained ventilation system in communication with air space in a toilet bowl;

wherein said bowl in communication with a water tank and a water supply line;

wherein said bowl in further communication with a drain conduit;

said drain conduit extending from a trap at one end and extending to a drain stack at another end;

said bowl has a rim therearound wherein said bowl communicates with said rim;

said bowl is for receiving human waste that produces the odorous air;

communicating the contents in said bowl through said trap and into said drain conduit so as to provide a passageway from said bowl to a drain stack;

said ventilation system includes an exhaust blower having a blower inlet and a blower outlet;

said blower inlet in communication with air space above the contents in said bowl;

said blower outlet in communication with said drain conduit downstream from said trap;

said rim including a seat and a pressure sensitive switch thereunder;

activating said switch for initial powering of said blower in response to a user sitting on said seat;

subsequently temporarily deactivating said exhaust blower with a cut-off switch during a flush and a lowering of the water in said water tank;

said cut-off switch comprising a float switch operably deactivating said exhaust blower when a float drops during the flush; and, said float switch operably activated when said float begins to rise thereby resuming power to said blower while said tank is supplied with water from said water line.

11. The method as defined in claim 10, wherein said cut-off switch interrupts power temporarily to said exhaust blower while said float drops, and resumes power to said exhaust blower while said float rises and after said float reaches to a predeterminable water level in said tank.

12. The method of claim 11, wherein said power continues to said blower after said float reaches to a prederminable water level in said tank and while said user continues sitting on said seat.

13. The method of claim 12, wherein said pressure sensitive switch deactivates said blower in response to the user removing pressure from said seat.

14. The method of claim 13, further comprising:

said exhaust blower further including a check valve between said blower outlet and said drain conduit for preventing the odorous air from flowing upstream from said drain stack into said blower outlet;

said check valve is spring biased to a closed position and when closed blocks the odorous air from said drain conduit to said blower outlet; and, said check valve is selectively biased to an open position when said exhaust blower is activated at a pressure at said blower outlet thereby opening said check valve to allow odorous air to flow from said blower outlet to said drain conduit.

* * * * *